United States Patent [19]

Ware et al.

[11] Patent Number: 4,691,771

[45] Date of Patent: Sep. 8, 1987

[54] RECOVERY OF OIL BY IN-SITU COMBUSTION FOLLOWED BY IN-SITU HYDROGENATION

[75] Inventors: Charles H. Ware, Roanoke; Leslie C. Rose, Rocky Mount, both of Va.

[73] Assignee: WorldEnergy Systems, Inc., Fort Worth, Tex.

[21] Appl. No.: 908,885

[22] Filed: Sep. 15, 1986

Related U.S. Application Data

[63] Continuation of Ser. No. 653,905, Sep. 25, 1984, abandoned.

[51] Int. Cl.[4] ..... E21B 43/243; E21B 43/30

[52] U.S. Cl. ..... 166/245; 166/261; 166/263

[58] Field of Search ..... 166/245, 251, 256, 257, 166/261, 263, 272, 303

[56] References Cited

U.S. PATENT DOCUMENTS

| | | | |
|---|---|---|---|
| 3,007,520 | 11/1961 | Frey | 166/245 X |
| 3,051,235 | 8/1962 | Banks | 166/261 |
| 3,064,728 | 11/1962 | Gould | 166/263 X |
| 3,084,919 | 4/1963 | Slater | 166/263 |
| 3,208,514 | 9/1965 | Dew et al. | 166/263 X |
| 3,327,782 | 6/1967 | Hujsak | 166/251 X |
| 3,794,113 | 2/1974 | Strange | 166/245 |
| 3,982,592 | 9/1976 | Hamrick et al. | 166/303 X |
| 4,241,790 | 12/1980 | Magnie | 166/263 X |
| 4,448,251 | 5/1984 | Stine | 166/263 |
| 4,483,398 | 11/1984 | Peters et al. | 166/245 X |
| 4,597,441 | 7/1986 | Ware et al. | 166/261 |

*Primary Examiner*—George A. Suchfield
*Attorney, Agent, or Firm*—Arthur F. Zobal

[57] ABSTRACT

Oxygen is injected into a petroleum bearing subsurface formation penetrated by production well and the petroleum in the formation is subjected to in-situ combustion to heat the formation in a zone surrounding the production well. After heating by the in-situ combustion, heated hydrogen is injected into the heated formation zone by way of the production well. By way of another well penetrating the petroleum bearing subsurface formation and spaced from the production well, fluid is injected into the formation to drive petroleum in the formation between the two wells to the production well for recovery. Hydrogenation of the petroleum occurs in the heated zone in the presence of hydrogen therein.

6 Claims, 4 Drawing Figures

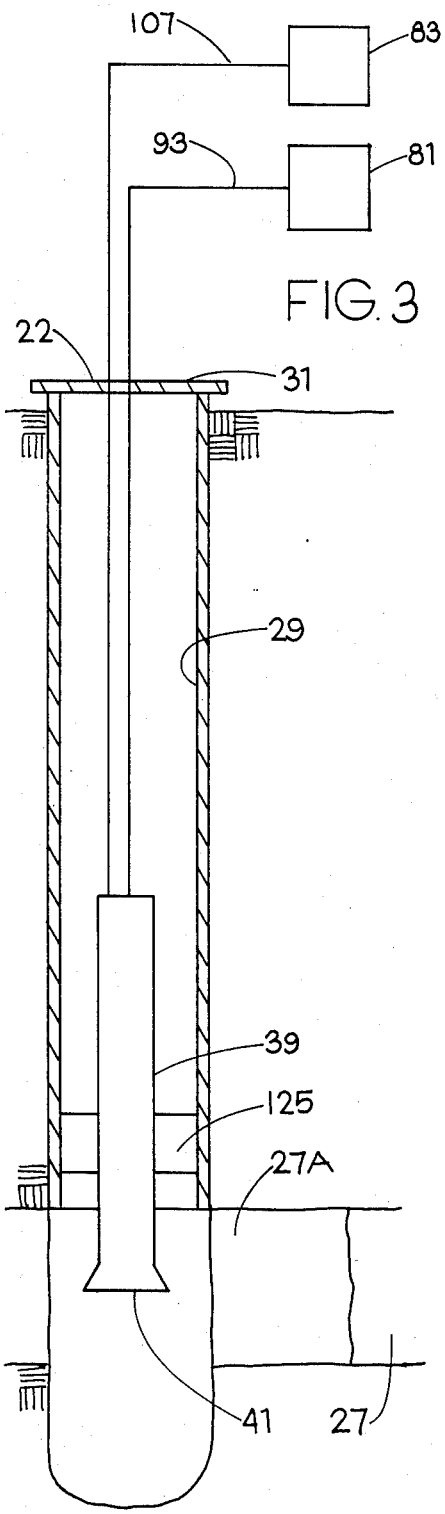
FIG. 3
FIG. 4
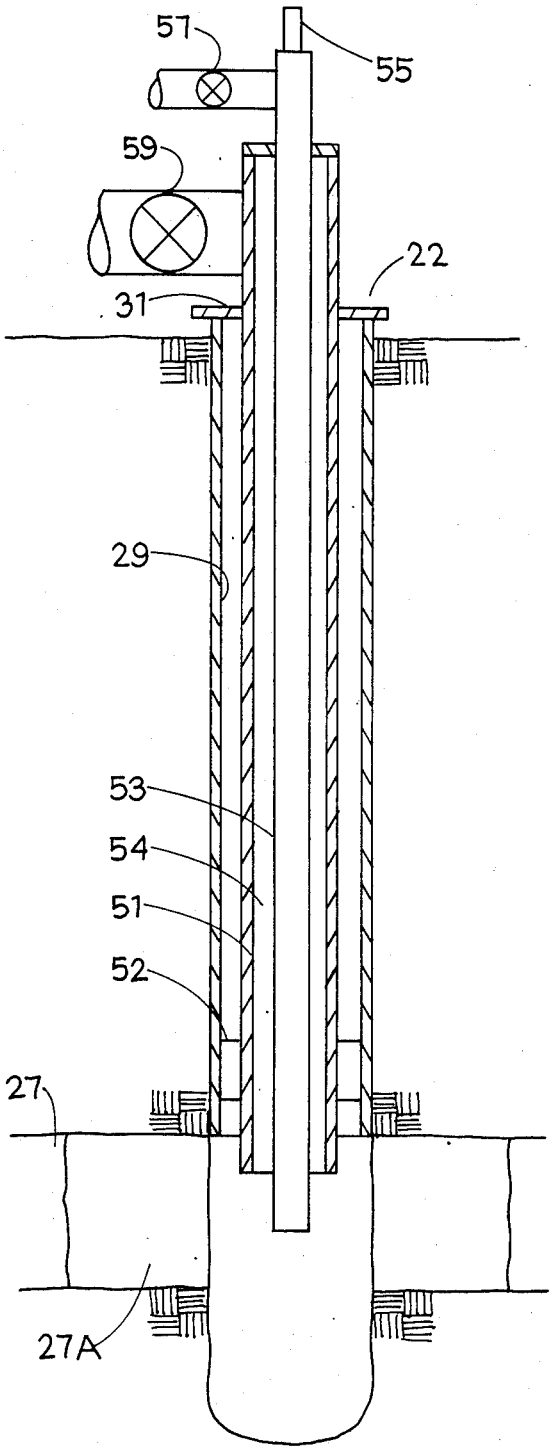

RECOVERY OF OIL BY IN-SITU COMBUSTION FOLLOWED BY IN-SITU HYDROGENATION

This is a continuation of co-pending application Ser. No. 653,905 filed Sept. 25, 1984, now abandoned.

BACKGROUND OF THE INVENTION

1. Field of the Invention

This invention is directed to a process of recovering petroleum from underground reservoirs.

2. Description of the Prior Art

Some of the largest known liquid petroleum deposits in the world are the Athabasca tar sands located in northern Alberta. It has been estimated that this area alone contains approximately three hundred billion barrels of oil. Other huge deposits of a similar nature are to be found in various parts of the United States and in Venezuela. Owing to the highly viscous nature of these deposits, their economic production has been extremely difficult. Numerous processes have been employed in efforts to recover such material including processes involving mining and centrifuging the tar and sand in the presence of certain solvents and surface active agents and subjecting the mined tar and sand mixture to treatment with hot water and separating the resulting upper oil layer. These and other methods which have been used, however, all require large labor and capital expenditures.

Underground combustion and steaming as a means of recovering deposits of this type have also been employed. In general, however, the very high differential pressures that must be applied between input and producing wells to recover the oil presents an extremely difficult problem. Frequently, the pressures that must be applied to shallow reservoirs of low permeability, i.e., less than 100 millidarcies, are higher than can either be applied economically or without causing uncontrolled fracturing of the formation which would lead to channeling or bypassing, or both.

Conventional underground combustion, i.e., an operation in which the combustion zone is propagated from a point near the face of an injection well toward a producing well, is extremely difficult with heavy viscous hydrocarbons in low permeability reservoirs of the type contemplated herein. Production is difficult in low-permeability reservoirs because the produced oil flows from the hot zone through the unheated zone to the production well. In the combustion zone the viscosity of the oil is at a minimum; however, as the pressure of the system forces the oil toward the producing well, the oil decreases in temperature to that of the unburned portion of the reservoir. Eventually, resistance to flow through the reservoir to the producing well becomes so great that combustion can no longer continue because it is impossible to supply air at a satisfactory rate to the burning zone.

The following U.S. Patents disclose various systems for and methods of recovering petroleum from underground formations: U.S. Pat. Nos. 2,877,847, 3,136,359, 3,327,782, 3,208,514, 3,982,591, 3,982,592, 4,024,912, 4,050,515, 4,077,469, 4,078,613, 4,183,405, 4,199,024, 4,241,790.

U.S. Pat. Nos. 3,208,514 and 3,327,782 disclose in situ hydrogenation of heavy oil and tar sands based upon achieving hydrogenation temperatures by means of in situ combustion using air. The use of this technique presents a significant difficulty. In order for hydrogenation of heavy oil or tar sands to take place, it is necessary to contact the oil with heat and hydrogen for a sufficient length of time so that enough of the reaction can take place to upgrade the oil so that it can be produced. In situ combustion with air is a flow process and by its very nature the nitrogen from the air tends to displace the oil in the formation. When forward combustion is stopped at any point there is a series of zones in the formation, each with its own characteristic temperature. Residual oil displacement areas are shown in FIG. 1 of the present application. Flow starts at the injection well and moves towards a production well. For forward dry combustion with air these zones are as follows:

Zone 1. (surrounding the wellbore of the injection well) high temperature (300°-800° F.); no oil; no water.

Zone 2. (combustion zone) very high temperature (typically 800°-1000° F. depending upon the permeability of the formation and the original oil and water saturations); steep oil gradient—no oil at the boundary with the first zone and 10-20% oil saturation at the other zone boundary; no water as such.

Zone 3. (steam chest) steep temperature gradient from the combustion zone temperature to the temperature for condensing steam at the formation pressure, typically 450°-550° F. for pressures of 400 to 1000 psig; oil saturations of 10-20%; water saturations of up to 80-90%.

Zone 4. (hot water zone) temperatures declining from that at the boundary of zone 3 to formation temperature, oil saturations increasing from 10-20% up to original oil saturations and water saturations decreasing from about 80°-90° at the boundary of zones 3 and 4 to original water saturations.

The oil which is in zone 2 has been distilled and is least susceptible to hydrogenation; it will not be produced because it is in the combustion zone. The same is true of the oil in zone 3 and the combustion zone will soon overtake it. The oil in zone 4 is suitable for hydrogenation but the temperatures there are at most the condensation temperature of steam.

Regardless of when the combustion is stopped and the hydrogen introduced, little or no oil will be at the temperature suitable for hydrogenation; temperatures below 550° F. result in hydrogenation rates which are too slow to be economical. Therefore, dry in situ combustion is not satisfactory for heating the oil in place to hydrogenation temperatures. Similar problems exist with forward wet combustion; it has the additional difficulty that the maximum formation temperatures which it creates are lower than those created by dry combustion.

U.S. Pat. No. 3,327,782 discloses a hydrogenation method for recovery of oil and upgrading the quality of viscous oils based upon heating the formation by means of reverse combustion using air. This has two significant drawbacks:

1. In low permeability reservoirs, it is difficult or, in some cases, impossible to maintain the gas fluxes necessary to achieve burn rates that will heat the formation to the temperatures required for hydrogenation—550° to 900° F.;

2. When using air as the combustion-supporting gas, the resulting partial pressure of the residual nitrogen will be above the original reservoir pressure. In order for hydrogenation to take place at significant rates, the hydrogen partial pressure must be at least 300 psi and preferrably greater than 500 psi. Therefore, it would be difficult, in most cases, to achieve this partial pressure without causing random fracturing of the reservoir overburden and the resulting escape of hydrogen. If hydrogen is used to displace the nitrogen, channeling will occur and only a fraction of the nitrogen will be removed; the result of this will be to have hydrogenation conditions existing in small random pockets of the formation. If the nitrogen is removed by reducing the reservoir pressure, water which had condensed in the formation during the heating step will evaporate and cool the formation to the saturation temperature at the formation pressure. This temperature reduction along with the expansion of the nitrogen and hydrogen will reduce the formation temperature well below that required for economical rates of hydrogenation.

In the process of U.S. Pat. No. 3,327,782, there is hydrogen flow through the formation from the injection well to the production wells. This results in low efficiency for the effective use (uptake) of the hydrogen that has been injected and a major economic cost in terms of lost hydrogen and/or hydrogen recovery from the produced gas.

U.S. Pat. No. 3,982,592 discloses a gas generator that may be operated to thermally crack the hydrocarbons (in the formation) into lighter segments for reaction with excess hot hydrogen to form lighter and less viscous end products and to hydrogenate or cause hydrogenolysis of unsaturated hydrocarbons to upgrade their qualities for end use. The term hydrogenation is defined as the addition of hydrogen to the oil without cracking and hydrogenolysis is defined as hydrogenation with simultaneous cracking. Cracking is defined as the breaking of the carbon bonds with a resulting reduction of the weight of the molecules. The flow of hydrogen and oxygen to the gas generator is controlled to maintain the temperature of the gases flowing through the outlet at a level sufficient to cause hydrogenation of the hydrocarbons in the formations. The cracked gases and liquids move through the formations to a spaced production well for recovery at the surface. Operation of the gas generator provides for a temperature at the outlet of the generator which is sufficient to cause hydrogenation, but the patent does not teach how to effectively contact oil, heat, and hydrogen simultaneously.

U.S. Pat. Nos. 4,183,405 and 4,241,790 also disclose the flow of hydrogen through the formations from an injection well to a production well and also the use of in situ combustion to generate enough heat for hydrogenation to take place and for distillation and cracking purposes.

DESCRIPTION OF OTHER PROCESSES

For a description of other processes of recovering petroleum from underground reservoirs, reference is made to copending U.S. patent application Ser. No. 614,044, filed May 25, 1984, and entitled Recovery of Oil By In Situ Hydrogenation and to copending U.S. patent application Ser. No. 614,045, filed May 25, 1984, and entitled Thermal Oil Recovery.

SUMMARY OF THE INVENTION

It is an object of the invention to provide a new and useful process of recovering petroleum from underground reservoirs or formations.

It is a further object of the invention to recover petroleum from underground reservoir formations wherein oil, heat, and hydrogen are contacted simultaneously in the reservoir formation to effectively carry out hydrogenation and/or hydrogenolysis to enhance recovery of the oil.

In carrying out an embodiment of the process, a first well is employed which penetrates a petroleum bearing reservoir formation. By way of said first well, a fluid containing oxygen is injected into said formation and the petroleum in said formation surrounding said first well is subjected to in situ combustion to heat said formation in a zone surrounding said first well. the injection of the fluid containing oxygen into said formation is terminated and hydrogen is injected into said heated formation zone by way of said first well for hydrogenation purposes. By way of another well, penetrating said formation and spaced from said first well, fluid is injected into said formation to drive fluids including petroleum in said formation between said other well and said first well, to said first well. The petroleum in said formation between said other well and said first well is driven in through said heated formation zone surrounding said first well and in the presence of hydrogen therein hydrogenation of said petroleum occurs. The treated petroleum is recovered from said first well.

In the preferred embodiment, after the termination of the injection of the fluid containing oxygen into said formation and before the injection of hydrogen therein, fluids containing petroleum are recovered from said formation by way of said first well. In addition, the hydrogen injected into said formation is at a temperature sufficient to cause hydrogenation of the petroleum in said heated formation zone.

In another embodiment, an auxiliary well which penetrates the heated formation zone near said first well may be employed to facilitate carrying out the process.

BRIEF DESCRIPTION OF THE DRAWINGS

FIG. 3 is a cross section of the earth formations illustrating a gas generation in a well.

FIG. 4 is a cross-section of the earth formations illustrating a producing system for a well.

DESCRIPTION OF THE PREFERRED EMBODIMENT

Figure 1:
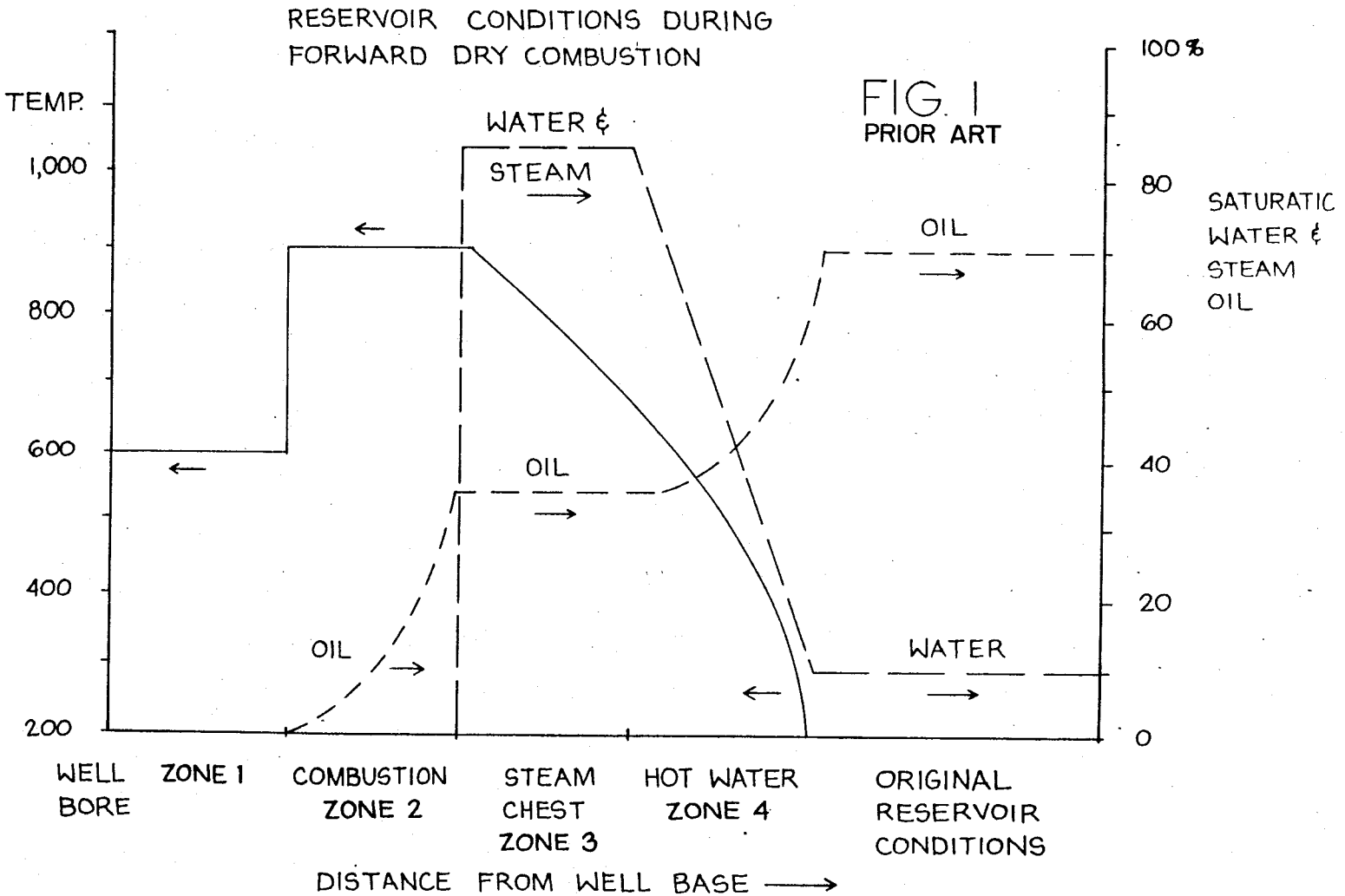
FIG. 1 PRIOR ART
FIG. 1 are curves illustrating reservoir conditions during forward drive combustion.
Figure 2:
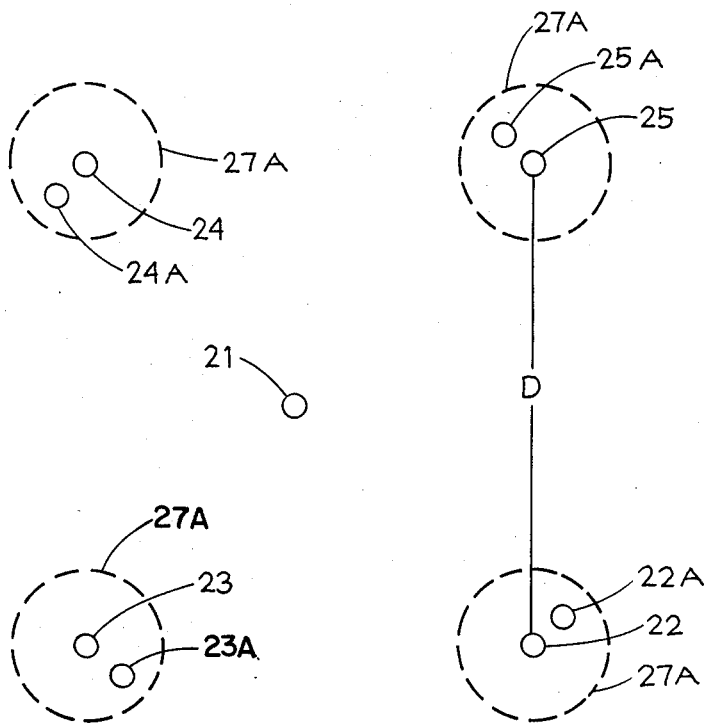
FIG. 2 is a plan view of injection wells and surrounding production wells employed for carrying out the invention.

Referring now to the drawings, FIG. 2 illustrates a pattern of five wells 21–25 which may be employed to carry out the invention. Well 21 is defined as the central injection well and wells 22–25 are defined as peripheral production wells. The invention is not limited to the use of any particular pattern of wells nor with a plurality of production wells, however, the use of a plurality of production wells makes the process of the invention more economical. The wells are drilled into the formations from the surface and penetrate a subsurface petroleum bearing formation or reservoir illustrated at 27 in FIGS. 3 and 4. Each of the wells is lined with steel casing 29 and has an upper well head 31. The casing may extend down to the level of the reservoir formation 27 as shown in FIGS. 3 and 4 or below the formation 27, in which case the casing will be perforated to provide fluid communication between the wells and the formation 27.

Preferrably the invention is used for recovering petroleum from tar sands or from a reservoir of viscous oil such as that having an API gravity in excess of −10°. It is to be understood that the invention may be used to recover petroleum from reservoirs of less viscous oil.

In carrying out the preferred embodiment of the process of the invention, oxygen with steam or water is injected from the surface into wells 21–25 for flow into formation 27. The oxygen injected has a temperature sufficient to cause spontaneous ignition of the oil or petroleum products in the formation surrounding the production wells. The oxygen with steam or water injected may have a temperature within the range of from about 200° to about 700° F. The oxygen reacts with the oil and causes the temperature to rise in the reservoir or formation surrounding the wells to 500° F. up to 1500° F. The actual temperature is determined by the amount of oil and water in the reservoir and the ratio of water and oxygen or steam to oxygen. The injection of oxygen is continued until the area or zones 27A surrounding the production wells have their temperature raised to at least 500° F. These zones each have a radius of about 10 feet up to 50 feet or more. The injection of the oxygen next is terminated; the pressure in the production wells is lowered and fluids comprising steam, CO2, oxygen, light gases and oil are recovered from the formation 27 by way of the production wells. This is done to open up the reservoir and to remove some of the undesirable products in the heated zones resulting from the in-situ combustion.

This phase of the process of preheating the formation surrounding the production wells by in-situ combustion is desirable in areas where there is little or no water for use for the production of steam for preheating purposes.

Hydrogen at a temperature of from 500° F. to about 900° F. is injected by way of the production wells into the heated zones 27A in the formation 27 causing the pressure to rise in the formation up to a level below the fracture point of the formation. This pressurization will cause the reaction of the hydrogen with the partially oxygenated oil that remains in the combustion zone as well as unreacted oil which has not been burned or displaced during the combustion step. The injection of the hydrogen is terminated and the pressure in the formation is maintained for several days as a hydrogen soak period allowing hydrogenation of the oil in the heated zones to take place. At pressures of, for example, 400 to 2000 p.s.i. and at temperature of, for example, 500° to 900° F., hydrogenation and/or hydrogenolysis of the oil in place can be effected, causing a decrease in oil viscosity.

After the hydrogen soak period, pressure in the production wells is lowered and fluids comprising treated oil are recovered from the heated zones by way of the production wells. When the pressure in the production wells is lowered, the gas (hydrogen) which is released from the oil and surrounding the production wells will push the oil in the direction of the lowest pressure, that is, toward the production wells. In this fashion, oil will be produced. Production at this time may not yield much treated oil and hence may be terminated if it is found that no treated oil is being produced.

Following this phase of the process, fluid drive is initiated from the injection well 21 to drive fluids, including petroleum in the formation 21 between well 21 and the production wells 22–25 to the wells 22–25. The petroleum in the formation between the injection well 21 and the production wells 21–25 is driven through the heated zones 27A to the production wells whereby hydrogenation and/or hydrogenolysis of the petroleum occurs in the heated zones in the pressure of hydrogen therein.

During the fluid drive process from well 21, the pressure in the production wells 22–25 is lowered and the wells 22–25 are placed on production. A mixture of treated oil (resulting from hydrogenation and/or hydrogenolysis, thereof), water, steam, and gas which was in the reservoir, if any, and unused hydrogen will be produced. The treated oil will have improved properties of lower viscosity, higher API gravity, possibly reduced sulphur and possibly reduced nitrogen.

Although the oxygen injected into the production wells 22–25 preferably is heated oxygen to cause spontaneous ignition of the oil for the in-situ combustion phase of the process, ignition can be achieved using an igniter, for example, an electric heater. Preferably pure oxygen is used however, it is to be understood that air enriched with oxygen may be employed or steam-oxygen mixtures or oxygen with added water. The in-situ combustion step from the wells 22–25 may be repeated after the injection of hydrogen through wells 22–25 and before the fluid drive step if upon sampling it is determined that the temperature of the oil was too low to support hydrogenation. In this case, the injection of hydrogen through wells 22–25 also may be repeated. If the in-situ combustion step from wells 22–25 raised the temperature of the formations around these wells to high levels, for example, near or up to 1000° F., or higher the hydrogen injected may not need to be heated.

The oil produced from the production wells 22–25 can be sampled during the fluid drive stage and if it is found that the produced oil has not been treated sufficiently, additional hydrogen may be injected into the reservoir 27 intermittantly during the fluid drive stage to enhance the hydrogenation and/or hydrogenolysis of the oil. When hydrogen is injected into the reservoir 27 through the wells 22–25, the fluid drive stage may be halted. The intermittant injection of hydrogen may comprise the steps of injection of hydrogen, a hydrogen soak period and a fluid drive period. This cycle may be repeated several times in order to properly treat the oil. Hydrogenation of the oil may occur during the hydrogen soak period of one or more of these cycles rather than during the fluid drive period particularly if the fluid drive period is relatively short.

As indicated above the fluid drive may be carried out by injecting fluids into the reservoir 27 by way of the well 21. The fluids then will flow outward from the well 21 toward the wells 22–25 driving the oil toward the production wells 22–25. The fluids for the drive may comprise carbon dioxide, propane, natural gas, propane, ethane, hydrocarbons from the $C_4$ to $C_{20}$, light petroleum fractions boiling up to saturated steam temperature at the reservoir pressure, or other fluids injected through the injection well 21 to decrease the viscosity of the oil and to increase production. The pressure of these fluids causes the oil to be driven to the production wells 22–25. As an alternative, a forward combustion drive may be initiated from the injection well 21 by injection hot oxygen or air into the reservoir 27 by way of the injection well 21. The hot oxygen or air will cause the petroleum products in the reservoir 27 to be spontaneously ignited due to the heat and pressure in the formation 27 around the injection well 21. Some of the oil in place will burn with the result that the temperature in the formation surrounding the well will be raised. Upon the continued injection of oxygen or air, the flame front and the expanding gases will push the oil outward toward the production wells 22–25 which then is recovered.

The hydrogen used in the process may be obtained from a variety of sources. In general, it is preferably to prepare it by well known methods, such as reforming or noncatalytic partial oxidation. The fuel for manufacture of hydrogen by such methods may be a gas fraction or a liquid fraction from the produced oil, or the gas or coke produced from thermal cracking of the viscous oil or tar. Cracking occurs to some extent in the formation, depending, of course, on the temperature. However, the lighter oil fractions may be separated from the oil produced and used as a reformer fuel in a known manner. An impure hydrogen stream such as that obtained by reforming without carbon dioxide removal may be employed in the inplace hydrogenolysis process. In some instances, carbon dioxide removal, or partial removal, by any of the well known methods may be advisable. The reformer product, which contains approximately 35 to 65 percent hydrogen, may be injected directly into the formation since the normal remaining impurities do not interfere to any substantial degree with the desired hydrogenolysis reaction. However, the hydrogen partial pressure in the formation must be high enough to maintain the desired hydrogenation and hydrogenolysis reactions. The gas from producing wells should contain an appreciable amount of hydrogen together with light gaseous hydrocarbons. This gaseous product can be used as a reformer feed to produce additional hydrogen for the process. As an alternative to the reforming methods of hydrogen production, there may be employed partial oxidation of any or all fractions of the produced oil; the hydrogen, CO, $CO_2$, $H_2S$ mixture may be further processed to produce a stream which is more or less pure hydrogen. While one or more walls are producing oil and gaseous hydrogen and one or more wells are receiving hydrogen, the produced hydrogen may be separated from the light hydrocarbon gases which are produced with it and a relatively pure stream of gaseous hydrogen produced. The gaseous hydrogen may be compressed and used for injection or may be compressed and stored for use in later injection cycles.

There now will be described more details of the wells and the equipment for carrying out the process of the invention. The pattern formed by wells 22–25 as shown is a square (having sides equal to a distance D) although it is to be understood that different patterns may be formed by the production wells. In one embodiment, the distance D may be equal to about 460 feet with the injection well 21 located centrally of the square pattern formed by production wells 22–25. It is to be understood that the space between the production wells may be greater or less than 460 feet.

Wells 22A–25A are auxiliary wells located close to their associated peripheral production wells 22–25 respectively. The auxiliary wells penetrate the reservoir 27 and are located such that they will be within the heated zones 27A surrounding their associated production wells. For example, well 22A may be located three to ten feet or more from well 22 depending upon how far out its heated zone 27A is expected to extend. The auxiliary wells are lined with casing in the same manner as their associated production wells. The auxiliary wells may or may not be used in carrying out the process of the invention depending upon the circumstances.

A gas generator of the type disclosed in U.S. Pat. Nos. 3,982,591, 3,982,592 or 4,199,024 may be located in all of the production wells 22–25 and in the injection well 21. A gas generator of this type is illustrated in FIG. 3 at 39 in well 22. All of the components of the gas generator 39 are not shown in the drawings of this application and reference is hereby made to U.S. Pat. Nos. 3,982,591, 3,982,592, and 4,199,024 for a detailed description of such a gas generator These three patents are hereby incorporated into this application by reference. The gas generator comprises an inflatable packer 125; a source of hydrogen 81 with a supply line 93 extending from the source 81 to the generator 39; and a source of oxygen 83 with an oxygen supply line 107 extending from the source 83 to the gas generator. In operation, hydrogen and oxygen are supplied to the gas generator 39; ignited and burned to produce gases which flow through its outlet 41. As disclosed in U.S. Pat. Nos. 3,982,591 and 3,982,592, the gas generator can be cooled by hydrogen. The gas generator can be operated to produce an excess amount of hot oxygen for in-situ combustion purposes. It can then be operated to produce an excess amount of hot hydrogen for hydrogenation purposes.

The gas generators in all of the production wells will be operated simultaneously to produce hot oxygen for in-situ combustion purposes and thereafter hot hydrogen for hydrogenation purposes. During this period, the gas generator in the injection well will not be operated. After the in-situ combustion step, the gas generators can be removed from the production wells 22–25 and production tubing and associated pumping equipment inserted into wells 22–25 to produce fluids from the wells. This equipment can be removed and the gas generators re-inserted into wells 22–25 for the hydrogen injection step. After the hot hydrogen has been injected and the soak period carried out, the gas generators 39 can then be removed from the production wells 22–25 and production tubing and associated pumping equipment inserted into wells 22–25 to produce the treated oil from the production wells 22–25. In the alternative, the gas generators 39 may be left in wells 22–25 and production tubing and associated pumping equipment inserted into auxiliary wells 22A–25A for production of the fluids and treated oil.

During the fluid drive process from the injection well 21, the gas generator in the injection well can be operated to produce gases including steam for drive purposes or hot oxygen for in-situ combustion for a forward combustion drive. If other fluids are used for the fluid drive process, such as carbon dioxide, propane, natural gas, etc., as mentioned above, these fluids can be injected into the formation through the gas generator in the injection well when the gas generator is not operating in its burning mode. During the fluid drive process and assuming that the gas generators are located in the production wells 22–25 and fluids are being produced from the auxiliary wells, the gas generators may be operated to produce an excess amount of hot hydrogen for injection into the reservoir 27 adjacent the production wells 22–25 if additional hot hydrogen is needed during this process. Hot hydrogen also may be injected into the reservoir 27 by way of the auxiliary wells, if needed, during the fluid drive process.

In the operation of the gas generator, the temperatures of the gases produced by the gas generator can be determined from calculation bases upon the amount of hydrogen and oxygen burned. In addition, the downhole gas pressures can be determined by calculations based upon the amount of hydrogen and oxygen fed to the gas generator. The fracture pressures of the overburden formations above the reservoir 27 can also be determined by calculations based upon industry standards and the depth of the reservoir 27.

FIG. 4 illustrates a production system which may be employed in wells 22–25 or auxiliary wells 22A–25A. The system comprises a conduit 51 with a packer 52 located between the conduit 51 and the casing 29 at a level slightly above the reservoir formation 27. The packer 52 may be an inflatable type of packer as disclosed in U.S. Pat. Nos. 3,982,591, 3,982,592, and 4,199,024. Extending though the conduit 51 is a production tube 53 through which the sucker rod 55 of a walking beam type of pump extends. For pumping purposes valve 59 will be closed, valve 57 opened and the pump operated to produce fluids through the production tubing 53 and valve 57. This system also can also be used in wells 22–25 to inject oxygen into the formation 27 for in-situ combustion purposes and then hydrogen for hydrogenation purposes in lieu of the gas generator 39. For this purpose valve 57 will be closed and valve 59 opened and the oxygen and hydrogen injected into formation 27 through the annulus 54 formed between the conduit 21 and the production tubing 53.

What is claimed is:

1. A method of recovering petroleum from an underground formation, comprising the steps of:

by way of a first well penetrating said formation, injecting at least oxygen into said formation and subjecting the petroleum in said formation surrounding said first well to in-situ combustion to heat said formation in a zone surrounding said well, terminating the injection of oxygen into said formation, injecting hydrogen into said heated formation zone by way of said first well, by way of a second well, penetrating said formation and spaced from said first well, injecting into said formation, fluid to drive fluids including petroleum, in said formation between said second well and a third well, to said third well, said third well being located near said first well such that said third well penetrates said heated formation zone, said petroleum in said formation between said second well said third well being driven through said heated formation zone surrounding said third well and in the presence of hydrogen, hydrogenation of said petroleum occurs, and by way of said third well, recovering petroleum driven to said third well.

2. The method of claim 1, wherein:

the petroleum in said formation surrounding said first well and said third well is subjected to in-situ combustion to heat said formation in said zone surrounding said first well and said third well to a temperature within a range of about 500° F. to 1500° F.

3. A method of recovering petroleum from an underground formation, comprising the steps of:

a. by way of a first well penetrating said formation, injecting at least oxygen into said formation and subjecting the petroleum in said formation surrounding said first well to in-situ combustion to heat said formation in a zone surrounding said first well, b. terminating the injection of oxygen into said formation, c. injecting hydrogen into said heated formation zone by way of said first well for hydrogenation purposes, d. recovering fluids from said formation by way of said first well, e. repeating steps a, b, c, and d, f. by way of another well, penetrating said formation and spaced from said first well, injecting into said formation, fluid to drive fluids including petroleum, in said formation between said other well and said first well, to said first well, g. said petroleum in said formation between said other well and said first well being driven through said heated formation zone surrounding said first well and in the presence of hydrogen, hydrogenation of said petroleum occurs, and h. by way of said first well, recovering petroleum driven to said first well.

4. The method of claim 3, wherein in steps a:

the petroleum in said formation surrounding said first well is subjected to in-situ combustion to heat said formation in said zone surrounding said first well to a temperature within a range of about 500° F. to 1500° F.

5. A method of recovering petroleum from an underground formation, comprising the steps of:

a. by way of a first well penetrating said formation, injecting at least oxygen into said formation and subjecting the petroleum in said formation surrounding said first well to in-situ combustion to heat said formation in a zone surrounding said well, b. terminating the injection of oxygen into said formation, c. injecting hydrogen into said heated formation zone by way of said first well, d. recovering fluids from said formation by way of a production well located near said first well such that said production well penetrates said heated formation zone, e. repeating steps a, b, c, and d, f. by way of an injection well, penetrating said formation and spaced from said first well and from said production well, injecting into said formation, fluid to drive fluids including petroleum, in said formation between said injection well and said production well, to said production well, g. said petroleum in said formation between said injection well said production well being driven through said heated formation zone surrounding said production well and in the presence of hydrogen, hydrogenation of said petroleum occurs, and h. by way of said production well, recovering petroleum driven to said production well.

6. The method of claim 5, wherein in steps a:

the petroleum in said formation surrounding said first well and said production well is subjected to in-situ combustion to heat said formation in said zone surrounding said first well and said production well to a temperature within a range of about 500° F. to 1500° F.

* * * * *